United States Patent [19]

Miram et al.

[11] Patent Number: 4,555,646

[45] Date of Patent: Nov. 26, 1985

[54] ADJUSTABLE BEAM PERMANENT-MAGNET-FOCUSED LINEAR-BEAM MICROWAVE TUBE

[75] Inventors: George V. Miram, Atherton; Yosuke M. Mizuhara, Palo Alto, both of Calif.

[73] Assignee: Varian Associates, Inc., Palo Alto, Calif.

[21] Appl. No.: 587,837

[22] Filed: Mar. 12, 1984

Related U.S. Application Data

[63] Continuation of Ser. No. 309,366, Oct. 7, 1981, abandoned.

[51] Int. Cl.[4] ..... H01J 23/08

[52] U.S. Cl. ..... 315/5.35; 313/442; 315/3.5

[58] Field of Search ..... 313/442, 443; 315/3.5, 315/5.34, 5.35

[56] References Cited

U.S. PATENT DOCUMENTS

| | | | |
|---|---|---|---|
| 2,687,490 | 8/1954 | Rich et al. | 313/443 X |
| 2,701,321 | 2/1955 | Rich | 313/443 |
| 2,707,758 | 5/1955 | Wang | 313/443 X |
| 2,828,434 | 3/1958 | Klein et al. | 313/442 |
| 2,859,363 | 11/1958 | Leisegang et al. | 313/443 |
| 2,974,246 | 3/1961 | Beck et al. | 313/443 |
| 3,092,745 | 6/1963 | Veith et al. | 313/443 |
| 3,092,746 | 6/1963 | Veith et al. | 313/443 |
| 3,255,370 | 6/1966 | Geppert | 313/443. |
| 3,259,790 | 7/1966 | Goldfinger | 313/442 |
| 3,268,754 | 8/1966 | Hart | 313/443 |
| 3,331,984 | 7/1967 | Allen, Jr. | 315/5.35 |
| 3,475,644 | 10/1969 | Miram | 313/443 X |
| 3,832,596 | 8/1974 | Nelson et al. | 315/5.35 |

*Primary Examiner*—Saxfield Chatmon

*Attorney, Agent, or Firm*—Stanley Z. Cole; Peter J. Sgarbossa

[57] ABSTRACT

A permanent-magnet-focused linear-beam high power millimeter-wave tube is externally adjustable for optimum electron beam optics during initial tube operation. The adjustment is made possible by providing an enlarged cavity within the cathode polepiece within which is housed a confined-flow magnetically-focused electron gun, and a cylindrical insert of magnetic material axially symmetrically disposed about the gun and in spaced relationship to and adjacent the gun insulator envelope. The insert may comprise iron or a radially magnetized permanent magnet, either alone or in combination, and more than one insert of magnetic material may be concentrically employed. In this manner, and by movement of the insert axially within the cavity toward and away from the gun, a finely controllable smooth adjustment of the beam diameter in the beam-microwave interaction region of the tube is effected over a wide range during initial operation. Substantially only the magnetic field in the vicinity of the gun is affected, and essentially no scalloping degradation of the beam in the interaction region is observed.

24 Claims, 3 Drawing Figures

ADJUSTABLE BEAM PERMANENT-MAGNET-FOCUSED LINEAR-BEAM MICROWAVE TUBE

This application is a continuation of application Ser. No. 309,366, filed Oct. 7, 1981, now abandoned.

FIELD OF INVENTION

This invention relates generally to high frequency linear beam microwave tubes, and more particularly to improved control and optimization of the electron beam optics in a permanent magnet-focused, high power linear beam tube.

BACKGROUND OF THE INVENTION

A long-standing problem in the linear-beam microwave tube art has been the limitations on microwave tube performance and longevity imposed by the inevitable imperfections in manufacturing tolerances and imprecisions in the electron beam optics at least partially resulting therefrom. Over the years many schemes have been implemented to compensate such problems, for example, to correct beam misalignments or improve beam convergence, and manufacturing techniques have improved to provide better tolerances. However, the more exacting requirements of advanced tube designs of recent years have in many cases outstripped the ability of prior expedients to cope with beam optics and tolerances imperfections. At the same time, the demand for improved efficiences has further exacerbated the problem, since for best efficiency, the diameter of the electron beam within the linear beam tube should desireably approach that of the beam tunnel defined within the tube internal structures through which the beam travels and interacts with microwave energy. In practice, however, the beam diameter must be held to a conservative fraction of the tunnel diameter. Otherwise, the inevitable variations in beam or tunnel diameter from one production tube to another would create an unacceptably high risk of failure due to excessive interception of beam electrons by the surrounding interaction structure.

The advent of linear beam tubes operating at millimeter wavelengths, say above 30 GHz, and at high power, has further exposed the inadequacies of the prior art and increased the need to escape beam optics and tolerances problems. Such millimeter wave tubes have become very important for addressing such needs as high resolution radar to detect previously unresolvable targets, but have not fully realized their potential due to the limited power levels available at reasonable tube system overall weights and sizes. For example, the highest power klystron recently available at 35 GHz has been a 1 KW CW tube requiring solenoid focusing, hence a solenoid power supply, and liquid cooling.

However, permanent-magnet-focused tubes have lagged in power output and efficiency due the far greater physical size constraints due to the small millimeter wavelengths involved, and the consequently greatly-increased effect of the inevitable beam optics and tolerance problems. In a tube for millimeter waves, the beam tunnel, for example, can often be under 30 mils in diameter. At such dimensions, it becomes much more difficult to employ efficient beam-to-tunnel diameter ratios, and the effects of any beam scalloping (variations in beam diameter with distances) are much more serious and likely to lead to an unacceptable degree of interception of beam electrons.

Furthermore, in recent years it has become desireable to utilize electron beams with very great current and power densities as a means to obtain high power outputs despite the need to adhere to conservative design and beam-to-tunnel-diameter ratios, and as a means to help overcome certain other limitations as well. Recently tubes have been devised with beam current densities in excess of 1000 amps per square cm., and power densities above 50 Megawatts per square cm. Obviously, such high power density beams compound beam optics and tolerances problems, and the risk of rapid tube disintegration and burnout is greatly increased in proportion to the increased beam power densities.

It would accordingly be highly desireable to provide a permanent magnet focused tube, particularly one operable in the millimeter wave range at high power, whose beam diameter could be precisely adjusted during operation to optimize performance and avoid the above problems. However, although the above problems impeding progress have certainly been recognized, this has apparently not led to recognition of the desireability of an adjustable-feature tube, let alone an actual design for a tube with such characteristics and one which would alleviate the above problems. This is despite the fact that the art shows many examples of tubes having beam directional deviation or convergence compensation, as well as solenoid-focused linear beam tubes with an auxiliary coil in the gun section in series with the solenoid to help improve beam optics.

Turning to some specific prior art examples, in U.S. Pat. No. 2,867,746, a magnetic lens incorporating a coil is placed just downstream of the electron gun about the neck of a solenoid-focused klystron tube, in order to compensate beam misalignment and to reduce scalloping. The electron gun itself is magnetically shielded and not under the influence of a magnetic field. Thus, it is not a confined-flow-focused gun, and is unaffected by these adjustments, which have essentially no effect on beam diameter.

In U.S. Pat. No. 3,259,790, radially moveable polepiece extensions are equalized with a fixed internal auxiliary polepiece downstream of the cathode to correct axial misalignment of the beam, and to adjust beam convergence in a solenoid-focused tube. However, any attempt to control beam diameter by means of the adjustments of this arrangement introduces an unacceptably large degree of beam scalloping, certainly in millimeter wave applications. In a similar context, shim members also have been inserted in the gun region as another axial correction expedient for the beam, but without effect on beam size.

In U.S. Pat. No. 3,331,984, an iron cylinder member, actually a portion of the focus electrode structure, is affixed within the cathode, inside the vacuum envelope, and in electrical and thermal communication with the electron emitting element, in order to increase the magnetic area convergence of the beam. However, this beam convergence compensation arrangement is not at all adaptable to beam adjustments of any kind, since it must be affixed within the vacuum envelope and hence, after assembly of the tube, cannot be modified in any way to adjust for any beam imperfections, just as would be the case for any other electrode. The high cathode temperatures at which the member in question must operate can threaten its magnetic qualities, and even if it were possible somehow to access the member, its operation at or near cathode potential, and the proximity of other structures, including the anode, would preclude any change in position because of the risk of arcing and the tight physical confines of the cathode. A further reference with similar characteristics, but intended only for low convergence gun applications, is U.S. Pat. No. 3,522,469.

SUMMARY OF THE INVENTION

Accordingly, one object of the present invention is to provide a permanent-magnet-focused, linear-beam microwave tube whose beam optics may be optimized for best performance and tube life from outside the vacuum envelope, and during initial tube operation;

Another object of the present invention is to provide a permanent-magnet-focused, linear-beam microwave tube whose beam diameter may be externally adjusted while avoiding the introduction of beam scalloping;

A related object of the present invention is to provide a linear beam microwave tube having a high convergence gun and whose beam may be set for increased or reduced diameter over an extended range during initial operation by means external to the electron gun, and operating at ground potential.

These objects are accomplished in one broad aspect of the invention by the provision of a linear beam, permanent-magnet-focused microwave tube having electron gun means adjacent one end of the tube for originating the linear electron beam along the tube axis, the gun including a cathode and envelope means, and collector means at the opposite end of the tube for collecting the electrons of the beam, along with means disposed between the gun and collector alongside the beam for supporting energy-exchanging electron beam-microwave interaction. Also included are permanent magnet circuit means for focusing the beam to a substantially uniform and narrow diameter within the interaction means, this magnet means including a polepiece extending about the gun. Cooperating with the foregoing is a means for externally adjusting substantially only the magnetic field within the gun region acting upon the beam, this means including highly magnetically permeable material disposed within the polepiece outside and adjacent the envelope means, and being moveable relative to the polepiece and gun during tube operation. In this manner, the diameter of the electron beam may be reduced or optimized within the interaction region during operation, while maintaining variations in the beam diameter with axial distance at a negligible level.

In accordance with further aspects of the invention, the magnetic material is provided within a cavity in the cathode polepiece within which is also disposed the electron gun. The magnetic material means extends axially symmetrically about the gun externally to the envelope means, is at ground potential, is spaced from the envelope means, and is moveable from outside the tube with respect to the gun toward and away from the anode region during operation.

Surprisingly, the tube is externally manipulable to effect adjustment of the electron beam diameter within broad limits, and such adjustment introduces substantially no degradation of the beam by scalloping over the complete range of the interaction region. Despite the adjustment being effected outside the gun envelope and within the polepiece cavity, the magnetic field within the interaction region is substantially undisturbed, while the field within the gun itself is changed by means of a simple mechanical operation, and with complete safety from high voltages, while the tube itself is in operation. This adjustment has the further unexpected advantage of being performable in a well-controlled finely-tunable manner, since it turns out that only a small physical displacement of the adjustment means is required to create an observable change in beam diameter, and that these changes are performable in such smooth and well-controlled manner over the entire substantial range of the adjustment.

DESCRIPTION OF THE PREFERRED EMBODIMENTS

Figure 1:
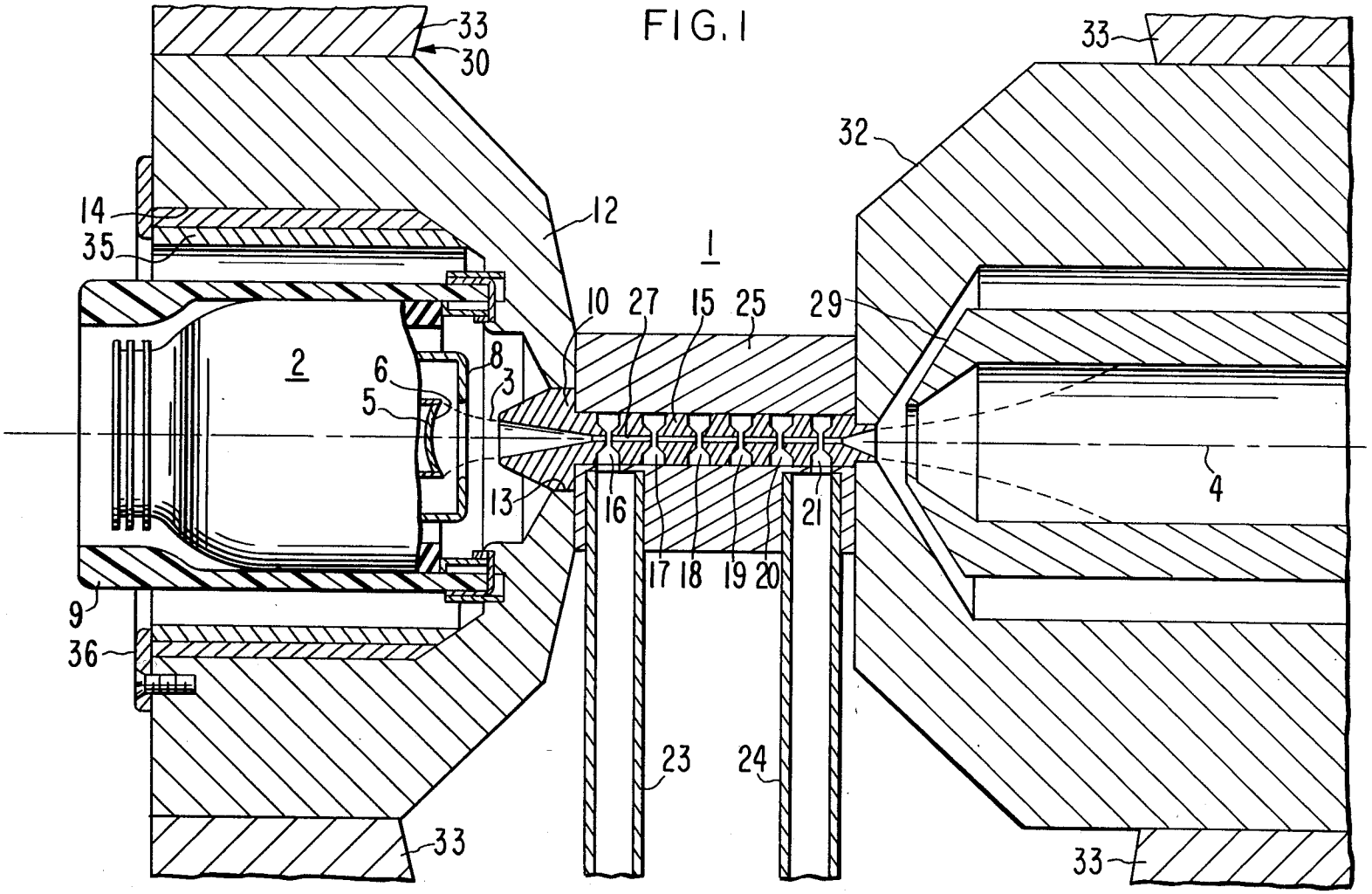
FIG. 1 is a longitudinal elevational sectional view, partially broken away, of a microwave tube in accordance with the present invention.

Referring now to the figures, particularly FIG. 1, a high-power, millimeter-wave, permanent-magnet-focused klystron tube 1 is illustrated, although the principles of the invention are equally applicable to other linear beam tubes, such as travelling wave tubes, and to non-millimeter wave applications. A high-convergence confined-field-flow electron gun assembly 2 is provided at one end of the tube for forming and projecting a beam 3 of electrons longitudinally along the tube axis 4. The gun desireably includes a thermionic cathode emitter body 5 having a concave emitting surface 6, a focus electrode 8, axially centered and longitudinally spaced from surface 6, a vacuum envelope enclosing the internal electrodes and emitter, and an insulating envelope 9 enclosing the entire assembly, and through which electrical terminals may be rearwardly extended. Both the cathode and usually the focus electrode operate at high negative potentials. An anode 10 is also provided just downstream of the focus electrode 8, and is operated at a high positive potential with respect to the cathode (and actually at ground potential). Other gun configurations may also be utilized, for example, of the type having a grid bonded directly to the cathode surface; see U.S. Pat. No. 4,096,406.

A cathode polepiece structure 12 extends from the tube axis 4 beginning just inwardly of gun 2, and defines an axially-centered aperture 13 within which anode 10 is held in electrical isolation from polepiece 12. Polepiece 12 extends radially away from anode 10 and also longitudinally about gun 2, to define an enlarged cavity 14 of generally cylindrical uniform diameter within which is housed electron gun 2. The diameter of cavity 14 is larger than that of gun envelope 9, and gun envelope 9, and vacuum envelope 7, are sealingly joined to polepiece 14 at the inner end of the envelopes, adjacent anode 10, with the remainder of envelopes being spaced from the walls of cavity 14. In this manner, those components in the gun region which are at high potentials relative to ground are both mechanically and electrically isolated from the polepiece.

On the side of cathode polepiece 12 opposite the gun is an electron beam-microwave interaction structure 15 of the tube, in which the electron beam undergoes an energy-exchanging interaction with resonant cavities defined in structure 15. In this case, the interaction structure 15 is that of a multicavity klystron amplifier, with its usual series of cavities separated by drift tubes, beginning with input cavity 16, the intermediate cavities 17–20 and the output cavity 21, each of which improves the characteristic bunching of the electrons in the beam, for enhanced gain. Of course, the multicavity klystron amplifier structure is not the only beam-interaction structure with which the invention can be provided; travelling wave tube structures with, for example, helix interaction structures, or coupled cavity structures, may also be provided as is well known, and several modes of operation are possible, for example, as pulsed or CW amplifiers, or as oscillators.

The input microwave signal is led into the input cavity 16 by means of input waveguide 23, and the amplified output microwave signal is extracted with the aid of output waveguide 24. The tube body 25, within which the resonant cavities are defined, is typically a block of metal, such as copper, within which the resonant cavities are machined; or into which prefabricated sections defining the cavities are affixed. An axial tunnel 27 defined by the beam drift tubes and connecting each cavity is further provided. The beam tunnel is of a narrow diameter, on the order of tens of mils to 100 mils; here, the tunnel is under 30 mils in diameter. It is desirable for the sake of efficiency of the electron beam-microwave interaction, that the beam tunnel and electron beam be close to each other in diameter, but in practice neither the beam tunnel tolerances, nor the uniformity of the beam along the axis, is normally precise enough to permit much more than a ratio of the order of 60%. This conservative fraction of beam diameter to tunnel diameter is therefore thought necessary to preclude too many electrons from impacting the tunnel walls, and thus, raising the tube body current, and the risk of tube burnout to unacceptable levels.

At the terminal end of the tube is provided an axially disposed conventional collector structure 29 to receive the electron beam 3 as it emerges from the interaction structure 15, with the electrons being accelerated toward the anode and collector by a high positive potential with respect to the cathode. The electron beam 3 is focused by focus electrode 8 with the aid of a magnetic circuit 30 to a very small diameter, which is a fraction of 100 mils; and which may be in the tens of mils range, here 5 to 30 mils, for certain millimeter wave applications. Magnetic circuit 30 comprises cathode polepiece 12, a similar collector polepiece 32 extending radially away from axis 4 between interaction structure 15 and collector 29, and also longitudinally about collector 29, and permanent magnets 33 (shown broken away) bridging the polepieces to complete the magnetic circuit. Magnetic circuit 30, by providing the appropriate even axial magnetic field throughout interaction structure 15, confines and maintains the electron beam at the same diameter throughout the interaction structure.

The small beam and tunnel diameter due to the ultra short wavelengths involved, and the need for adequate beam-wave interaction efficiencies and bandwidths, means that beam power densities must be very high for adequate power output. Unfortunately, this only exacerbates the aforementioned tolerances problem arising from small size, and increases the risk of high body current and failure, even with conservative beam to tunnel diameter ratios. In fact, manufacturing yields have heretofore been too low to permit commercial manufacture in large quantities of many desireable millimeter wave tube configurations, since due to the above factors, even small inaccuracies in beam or tunnel size or uniformity can have immediate catastrophic consequences.

In one aspect of the present invention, these problems are alleviated by the provision of one or more inserts 35 of high magnetic permeability disposed within enlarged polepiece cavity 14 axially symmetrically about, and spaced from, gun 2, but in contact with the cavity walls. Such inserts may take various forms, as will be further illustrated and described in connection with FIGS. 2 and 3. They should comprise magnetic material, such as iron, and may even include permanent magnet portions in some embodiments. In each case, the inserts extend axially adjacent insulating to tube envelope 9, but are evenly spaced therefrom. At least one portion extends generally from the outside edge of cavity 14 to a point at the inside terminus of cavity 14 adjacent the axial position of anode 10. The inserts, which are generally cylindrical in form, are normally moveable from outside the tube by manipulating them toward or away from the gun and anode region by the ends adjacent the outermost edge of cavity 14, as will further be described below. Once the optimal position and configuration has been found, the inserts may be locked into place by affixing a flange 36 over the inserts to the end face of polepiece 12.

It has been found that the inserts, despite their location about gun 2, surprisingly enable external adjustment from outside the tube of electron beam diameter within interaction structure 15 during tube operation, either to increase or reduce same, simply by moving the inserts in or out, and/or by adding additional inserts, as in FIG. 1 or utilizing a thicker insert. This adjustment may be effected within unexpectedly broad limits, namely plus or minus 10% of beam diameter (in the case of one of the alternative embodiments, plus or minus 15%). But more importantly than the absolute range of adjustment is the surprising advantage that the adjustment of beam diameter can be effected over this range without the introduction of scalloping, i.e., non-uniformities in beam diameter with axial distance. Virtually no change in such beam non-uniformities beyond the nominal percentage which already may be initially present was observed by virtue of the adjustment of the beam in accordance with the invention, unlike many prior beam-control expedients, which in any case have not provided any satisfactory adjustability of beam diameter.

Figure 3:
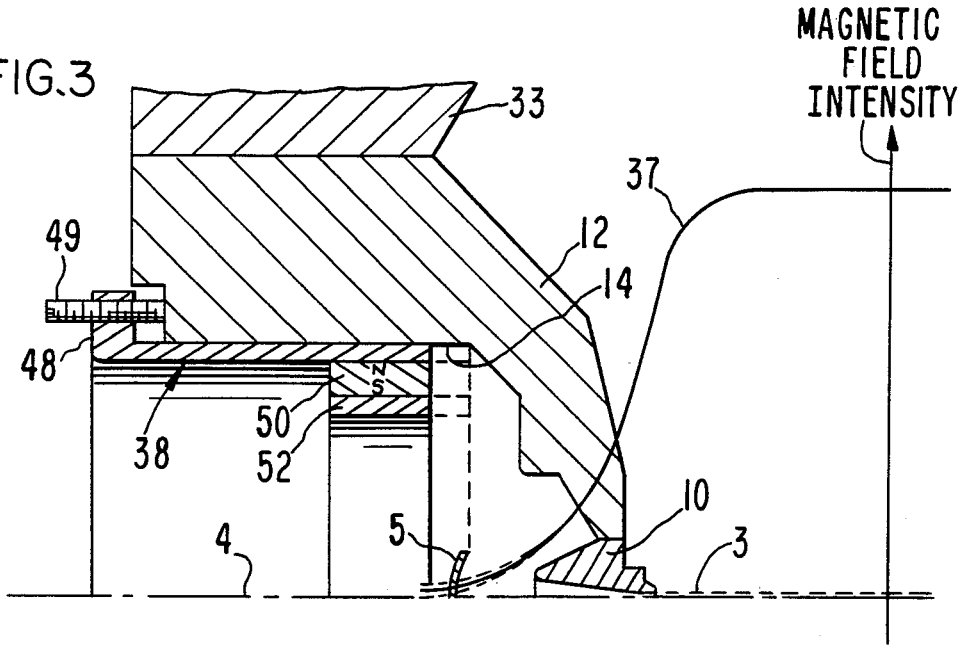
FIG. 3 is a detailed fragmentary view of yet another alternative embodiment similar to that of FIG. 2, but showing only the structure above the tube axis; and also showing a plot of the focusing magnetic field intensity with distance along the tube axis, and the changes effected therein and in the beam by means of the present invention.

In FIG. 3, the plot 37 of beam focusing magnetic field illustrates the effect of these adjustments. The vertical axis is indicative of field intensity, while the horizontal axis, which is also the axis 4 of the tube, indicates distance along the tube. The plot then illustrates how the focusing field intensity changes with axial distance along the tube. Cathode emitter 5 and the electron beam 3 itself is shown schematically, as is a portion of cathode polepiece 12, and an alternative adjustable cylindrical insert 38, comparable to inserts 35 in FIG. 1, and likewise positioned within polepiece cavity 14. The solid line portion of the curve illustrates the normal magnetic field intensity along the tube, if the tube were conventionally made without the inserts. The broken-line portion of the curve 37 illustrates the manner in which the field intensity may be changed by the use and adjustment of the inserts. For example, with insert 38 at its axially most extreme inward position, shown in phantom outline, the field in the gun region is thereby adjusted to its maximum useful value, represented by the upper broken-line portion of the curve. With the insert withdrawn to its outer most useful axial position as illustrated, the field in the gun region is thereby adjusted to its minimum useful value, represented by the lower broken line of the curve. In either event, it will be noted that the only changes by virtue of these adjustments occur in the region of cathode 5. In the portion of the curve beyond polepiece 12 the curve remains unchanged, and hence, the field applied to the interaction structure of the tube is unchanged.

Thus, for the first time, precise adjustment of beam optics can be affected without scalloping effects, and during tube operation. This may, in practice, be accomplished in several ways. For example, during checkout and initial operation of the tube upon completion of manufacture, a coil may be inserted about gun 2 in the space between it and the walls of polepiece cavity 14, and the tube RF response, including gain, bandwidth, and degree of beam interception measured and optimized by adjusting the coil current to arrive at the best value of cathode field. This value can then be duplicated by an insert of proper thickness and axial length (or the use of two or more inserts of lesser thickness). For a confined-flow-focused gun of a given design, in which the maximum magnetic field $B_o$ is predetermined, the cathode magnetic field $B_c$ and beam diameter will adhere to the relationship:

$$R_o = \frac{K}{(B_o/B_c)^{\frac{1}{2}}} \text{ or } R_o = K\sqrt{B_c}$$

where $R_o$ is the beam radius, and K is a constant. However, as implied above, adjustments normally can be made empirically without the need for precise calculations except to establish broad limits.

Figure 2:
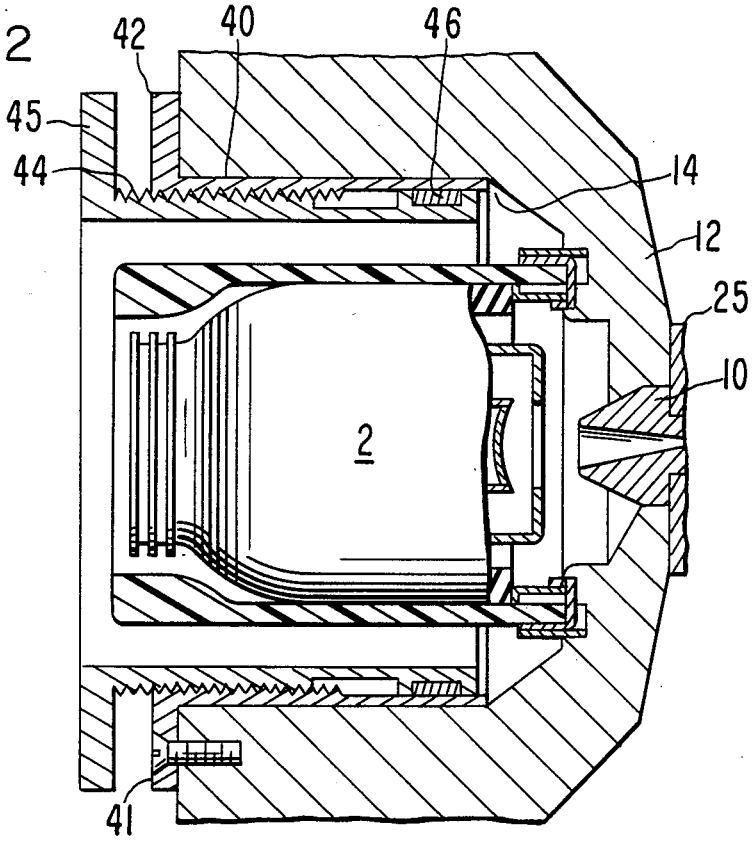
FIG. 2 is an elevational sectional fragmentary view of an alternative embodiment of the electron gun and adjacent surrounding tube structure similar to that shown in FIG. 1.

The foregoing procedure may be considerably simplified where beam tunnel, electron beam, and manufacturing tolerances are already fairly good, and only a modest degree of adjustment of the beam is required for maximum gain efficiency or bandwidth. For example, only a small axial movement of a standard thin insert may then be required; or the embodiments of FIGS. 2 or 3 may preferably employed. In FIG. 2, gun 2, gun insulating envelope 9, polepiece 12, cavity 14 and anode 10 are all as in FIG. 1, with polepiece 12 shown broken away. As in FIG. 1 a pair of cylindrical inserts are employed concentrically within the other, comprising highly magnetically permeable material such as iron. The innermost hollow cylinder 40 is of the same uniform outer diameter as the inner diameter of cavity 14, and is in engagement with the cavity wall, as well as being locked into position by means of set screw 41 through an outer flange 42 thereof. A second thin hollow cylinder 44 (whose thickness may be different in various applications, depending on need) has an outer diameter generally similar to the inner diameter of cylinder 40, with the outer face of cylinder 44 and the inner face of cylinder 40 being complementarily threaded.

Cylinder 44 is further provided with an outermost flange 45, by which cylinder 44 may be rotated so as to move inwardly or outwardly of cavity 14. Hence, a greater or lesser amount of highly permeable magnetic material is brought into the gun region, and influences the magnetic field therein accordingly. Thereby, the diameter of the electron beam in the microwave interaction region may be smoothly changed within a margin of plus or minus 10%, as we have seen. In most cases, the adjustment needed to optimize the performance of the tube will be quite a small one. As indicated by FIG. 2 and its magnetic field intensity curve, the adjustment is inherently a finely controllable one, and the above threaded arrangement further aids in making precise finely tunable small changes which normally are all that is required to obtain the best gain, bandwidth and efficiency from the tube.

In certain applications, it may be necessary to utilize lower convergence electron guns, rather than the very high convergence guns heretofore assumed. Also, even with higher convergence guns, it may be found that satisfactory beam adjustment requires the presence of an insert of magnetic material whose thickness or axial extent begins to interfere with the high voltage insulative holdoff capacity of the gun insulating envelope 9, which must isolate the high voltage present inside the gun from ground and the surrounding polepiece. In such cases, a permanent auxiliary element for the inserts is provided, either to obtain the same degree of magnetic field correction with less metal, or to obtain, especially in the lower convergence gun case, a degree of magnetic field correction beyond that possible only with the unaided inserts. For example, as shown in FIG. 2, a small, radially magnetized permanent magnet 46, preferably of samarium cobalt, may be provided adjacent the leading edge of inner cylinder 44. The magnet is preferably a thin continuous ring magnet, but could also be comprised of small sections of permanent magnet arranged symmetrically in a ring pattern about the cylindrical insert axis. The presence and placement of this permanent magnet material allows thinness and less massive inserts to be utilized for a given level of correction, and/or provides a greater degree of correction, for example, up to ±15% of beam diameter, approximately, than would otherwise be possible from a physically small insert which utilized only iron. In this manner voltage stand-off capabilities may be better preserved; also, the benefits of the invention may be provided even in tubes with lower convergence guns.

In applications where either only a small correction suffices to optimize performance, or where the presence of excess metal must be minimized, say because of the aforementioned high voltage hold-off problem, the alternative insert 38 shown in FIG. 3 may be the most useful. It comprises a thin inner support sleeve 48 with a depth generally comparable to that of polepiece cavity 14. It may optionally be flanged at the outermost end, to accept an adjustment screw 49 extending through the flanged portion and bearing on an end portion of polepiece 12 just outside cavity 14. Thus, rotation of screw 49 serves to move the sleeve 48 axially inwardly or outwardly, and is a convenient way of making the precise, finely tuned adjustment which has now been found to give optimal tube performance.

At the innermost end of sleeve 48, a layer 50 of permanent magnet material is affixed to the inner surface of the sleeve in a ring configuration of modest thickness, and with an axial depth which is a small fraction of that of sleeve 48. As in FIG. 2, the magnetic layer is radially polarized, and may be either a continuous ring magnet, or comprise small magnets in a small matrix to form the ring. Finally, a layer 52 similar to layer 50, and of magnetic material such as iron, but which desirably is thinner than layer 50, is optionally present inwardly of layer 50, particularly when layer 50 is comprised of several discrete magnets, in order to distribute the magnetic flux more evenly about the gun.

It will be appreciated that the above described embodiments are merely exemplary, not mutually exclusive, and may be varied considerably while remaining within the scope of the invention. For example, the advantages of beam-diameter optimization might well be combined with a beam misalignment compensation feature by adding a transversely-magnetized portion to one of the exemplary inserts above; the alignment of the beam, as well as its diameter, could then be changed by axial adjustment of such an insert. Although especially valuable for millimeter wave applications, the principles of the invention provide valuable advantages in any linear beam microwave tube context. For the first time, a tube design has been provided which enables adjustability from outside the tube of gain, efficiency and bandwidth during operation in a safe manner, isolated from high voltages, and without the risk of scalloping degradation of the electron beam. For the first time, such adjustability of beam diameter in the interaction region is performed by a simple mechanical manipulation in the gun region, and is accurately and finely controllable. A wide range of beam adjustment is enabled by the invention, while only a small physical displacement, as by an adjustment screw, is necessary. The adjustment can easily and rapidly be performed on each individual production tube, and each such tube thereby custom-optimized for best gain, efficiency and bandwidth during initial operation and testing. Thus, conventional beam to tunnel diameter design limits can be safely exceeded, and the levels of efficiency and gain not heretofore consistently obtainable from production tubes are now very easily provided on a regular production basis. At the same time, manufacturing yields, especially for the difficult to fabricate higher power permanent magnet millimeter wave linear beam tubes are greatly improved, since corrections can usually be made to prevent the almost immediate failure which would otherwise occur during testing if a minor beam optics problem is present at the high beam powers and small sizes required in such tubes.

What is claimed is:

1. A magnetically-focused linear beam microwave tube having a central axis, said tube comprising:

electron gun means adjacent one end of said tube for originating a strongly converging electron beam, said gun including a cathode having a concave emitting surface, and an envelope means, said envelope means including electrically insulating material, said gun operable at a high voltage;

collector means at the opposite end of said tube for collecting the electrons of said beam;

means disposed between said gun and collector alongside said beam for supporting energy-exchanging electron beam-microwave interaction;

said electron gun means, said means for supporting energy-exchanging interaction, and said collector means being in a vacuum-tight relationship;

an anode having a passage therethrough for accepting said beam from said gun, said anode operable at a voltage which is positive with respect to said cathode;

magnetic circuit means for focusing said beam to a substantially uniform and narrow diameter within said interaction means, said circuit means including a polepiece extending about said gun;

means for externally adjusting primarily the magnetic field acting on said cathode, said means for adjusting the magnetic field being substantially at ground potential during tube operation, said means for adjusting the magnetic field including magnetic material disposed within said polepiece outside and adjacent said envelope means, and being moveable axially about said cathode during tube operation, said magnetic material including at least one permanent magnet portion, whereby the diameter of said electron beam may be optimized, while maintaining variations in said beam diameter with beam travel at a negligible level; and means for fixing the position of said means for adjusting the magnetic field after beam diameter optimization.

2. A magnetically-focused linear beam microwave tube having a central axis, said tube comprising:

electron gun means adjacent one end of said tube for originating a strongly converging electron beam, said gun including a cathode having a concave emitting surface, and an envelope means;

collector means at the opposite end of said tube for collecting the electrons of said beam;

means disposed between said gun and collector alongside said beam for supporting energy-exchanging electron beam-microwave interaction;

an anode having a passage therethrough for accepting said beam from said gun, said anode operable at a voltage which is positive with respect to said cathode;

said electron gun means, said means for supporting energy-exchanging interaction, said anode and said collector means being in a vacuum-tight relationship;

magnetic circuit means for focusing said beam to a substantially uniform and narrow diameter within said interaction means, said circuit means including a polepiece extending about said gun, said polepiece defining an axial cavity therewithin, said envelope means being positioned within said cavity, said cavity being of a transverse diameter larger than the transverse dimensions of said envelope means;

means for externally adjusting substantially only the magnetic field within the gun region, said means including a hollow cylinder of magnetic material disposed within and engaging said cavity, and outside and adjacent said envelope means in spaced coaxial relationship thereto to insure isolation at gun operating voltages, said means being moveable axially in the vicinity of said gun during tube operation, whereby the diameter of said electron beam may be reduced or optimized during operation, while maintaining variations in said beam diameter with beam travel at a negligible level; and means for fixing the position of said means for adjusting the magnetic field after beam diameter optimization.

3. A magnetically-focused linear beam microwave tube having a central axis, said tube comprising:

electron gun means adjacent one end of said tube for originating a strongly converging electron beam, said gun including a cathode having a concave emitting surface, and an envelope means;

collector means at the opposite end of said tube for collecting the electrons of said beam;

means disposed between said gun and collector alongside said beam for supporting energy-exchanging electron beam-microwave interaction;

an anode having a passage therethrough for accepting said beam from said gun, said anode operable at a voltage which is positive with respect to said cathode;

said electron gun means, said means for supporting energy-exchanging interaction, said anode and said collector means being in a vacuum-tight relationship;

magnetic circuit means for focusing said beam to a substantially uniform and narrow diameter within said interaction means, said circuit means including a polepiece extending about said gun; said polepiece defining an axial cavity therewithin, said envelope means being positioned within said cavity, said polepiece extending inwardly to define a central aperture of diameter smaller relative to that of said axial cavity, said cavity terminating in said aperture, said envelope means being of larger diameter than said aperture, but smaller than said axial cavity, said envelope means extending into said cavity to a position closely adjacent said aperture;

means for externally adjusting substantially only the magnetic field within the gun region, said means including magnetic material disposed within said polepiece outside and adjacent said envelope means, and being moveable axially between positions in the vicinity of said gun during tube operation, said means extending inwardly into said axial cavity and generally symmetrically about said gun in even spaced relationship to said gun, whereby the diameter of said electron beam may be reduced or optimized during operation, while maintaining variations in said beam diameter with beam travel at a negligible level; and means for fixing the position of said means for adjusting the magnetic field after beam diameter optimization.

4. The tube of claims 2 or 3 in which said envelope means includes electrically insulating material, said gun operates at a high voltage, and said means for adjusting the magnetic field is substantially at ground potential during tube operation.

5. In a magnetically-focused linear electron beam microwave tube having a central axis:

a moderately-to-highly converging, confined-field-flow-magnetically-focused electron gun means at one end of said tube for developing and projecting an electron beam along said axis, said gun including a cathode having a concave emitting surface operable at a high negative voltage, and an insulating envelope;

collector means at the opposite end of said tube for collecting the electrons of said beam;

electron beam-microwave interaction means extending along said axis in vacuum-tight relationship with said cathode, said interaction means defining a tunnel for said beam;

said electron gun means and said means for supporting energy-exchanging interaction being in a vacuum-tight relationship;

a polepiece positioned about said gun and having a restricted outlet opening into said interaction means; said electron beam passing into said interaction means via said outlet;

an anode axially disposed adjacent said restricted outlet and having a passage therethrough for accepting said beam from said gun, said anode operable at a voltage which is positive with respect to said cathode; and an externally adjustable first magnetic material means interposed between said gun envelope and said polepiece, said means including at least one permanent magnet portion, said means being at ground potential and moveable with respect to said gun and polepiece toward or away from said cathode between axial positions in the vicinity of said cathode for enabling substantial adjustment of said electron beam diameter for optimal performance, while holding variations in beam diameter along said axis to a minimum; and means for fixing the position of said means for adjusting the beam diameter after beam diameter optimization.

6. In a magnetically-focused linear electron beam microwave tube having a central axis:

a converging, confined-field-flow-magnetically-focused electron gun means at one end of said tube for developing and projecting an electron beam along said axis, said gun including a cathode having a concave emitting surface operable at a high negative voltage, and an insulating envelope of generally cylindrical shape;

collector means at the opposite end of said tube for collecting the electrons of said beam;

electron beam-microwave interaction means extending along said axis in vacuum-tight relationship with said cathode;

an anode having a passage therethrough for accepting said beam from said gun, said anode operable at a voltage which is positive with respect to said cathode;

a polepiece positioned about said gun and having a restricted outlet opening into said interaction means; said electron beam passing into said interaction means via said outlet, said polepiece defining an axial cavity of substantially uniform circular cross section and diameter throughout most of its axial length, said gun envelope positioned within said cavity, the diameter of said envelope being less than the diameter of said cavity;

and an externally adjustable first magnetic material means interposed between said gun envelope and said polepiece, said means being at ground potential and being axially moveable with respect to said gun and polepiece toward or away from said gun between axial positions in the vicinity of said gun, for enabling substantial adjustment of said electron beam diameter for optimal performance, while holding variations in beam diameter along said axis to a minimum; and means for fixing the position of said means for adjusting the beam diameter after beam diameter optimization.

7. The tube of claims 5 or 6 in which said magnetic material means is rotatable relative to said gun.

8. The tube of claims 5 or 6 in which a second magnetic material means is affixed within said first means.

means for fixing the position of said means for adjusting the magnetic field after beam diameter optimization.

21. The tube of claims 1, 2, 3, 5, 6, 10 or 11 in which said means for adjusting the magnetic field includes a ring of magnetic material disposed about said envelope and axially moveable relative thereto.

22. The tube of claims 1, 2, 3, 5, 6, 10, 11 or 20 in which said magnetic material comprises iron.

23. The tube of claims 2, 3, 6, 10, 11 or 20 in which said magnetic material includes at least one permanent magnet portion.

24. The tube of claims 1, 2, 3 or 20 in which said means for adjusting the magnetic field includes axially extending portions portions to permit manual adjustment during tube operation.

* * * * *